US007182068B1

(12) United States Patent
Sturman et al.

(10) Patent No.: US 7,182,068 B1
(45) Date of Patent: Feb. 27, 2007

(54) COMBUSTION CELL ADAPTED FOR AN INTERNAL COMBUSTION ENGINE

(75) Inventors: Oded Eddie Sturman, Woodland Park, CO (US); Tibor Kiss, Manitou Springs, CO (US); James A. Pena, Cardiff By The Sea, CA (US); Timothy P. Kranz, Woodland Park, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 0 days.

(21) Appl. No.: 11/235,531

(22) Filed: Sep. 26, 2005

Related U.S. Application Data

(63) Continuation of application No. 10/894,299, filed on Jul. 19, 2004, now abandoned.

(60) Provisional application No. 60/488,604, filed on Jul. 17, 2003.

(51) Int. Cl.
*F02M 37/04* (2006.01)
*F02M 47/02* (2006.01)

(52) U.S. Cl. ..... 123/446; 123/90.12; 239/88

(58) Field of Classification Search ..... 123/446, 123/447, 508, 90.12, 90.13
See application file for complete search history.

(56) References Cited

U.S. PATENT DOCUMENTS 4,821,689 A 4/1989 Tittizer et al.
4,856,713 A 8/1989 Burnett
5,108,070 A 4/1992 Tominaga
5,237,976 A 8/1993 Lawrence et al.
5,429,309 A 7/1995 Stockner
5,460,329 A 10/1995 Sturman
RE35,303 E 7/1996 Miller et al.
5,638,781 A 6/1997 Sturman
5,641,121 A * 6/1997 Beck et al. ..... 239/92
5,669,355 A 9/1997 Gibson et al.
5,682,858 A 11/1997 Chen et al.
5,687,693 A 11/1997 Chen et al.
5,697,342 A * 12/1997 Anderson et al. ..... 123/446
5,713,316 A 2/1998 Sturman
5,738,075 A 4/1998 Chen et al.
5,806,474 A 9/1998 Paul et al.
5,826,562 A 10/1998 Chen et al.
5,833,146 A 11/1998 Hefler
5,950,931 A * 9/1999 Beatty et al. ..... 239/533.8
5,960,753 A 10/1999 Sturman
5,970,956 A 10/1999 Sturman
6,012,644 A 1/2000 Sturman et al.
6,026,785 A 2/2000 Zuo (Continued)

*Primary Examiner*—Thomas Moulis
(74) *Attorney, Agent, or Firm*—Blakely, Sokoloff, Taylor & Zafman LLP

(57) ABSTRACT

Herein disclosed is a combustion cell adapted for an internal combustion engine, comprising i) a hydraulic engine valve actuation portion capable of providing a selection of two different and stable engine valve lift (i.e., open) positions per engine valve or per coupled engine valves and ii) a fuel injection portion capable of providing a selection of comprising i) a hydraulic engine valve actuation portion capable of providing two stable engine valve lift positions and ii) a fuel injection portion capable of providing a selection of one, two or three injection pressure levels for injection fuel.

The combustion cell provides more flexibility in control of incoming intake air, outgoing exhaust gas, and/or incoming injection fuel relative to an engine combustion chamber so as to better match engine operating conditions that may change over time.

17 Claims, 14 Drawing Sheets

U.S. PATENT DOCUMENTS

| | | | |
|---|---|---|---|
| 6,148,778 | A | 11/2000 | Sturman |
| 6,161,770 | A | 12/2000 | Sturman |
| 6,173,685 | B1 | 1/2001 | Sturman |
| 6,257,499 | B1 | 7/2001 | Sturman |
| 6,308,690 | B1 | 10/2001 | Sturman |
| 6,360,728 | B1 | 3/2002 | Sturman |
| 6,374,784 | B1 | 4/2002 | Tischer et al. |
| 6,378,497 | B1 | 4/2002 | Keyster et al. |
| 6,415,749 | B1 | 7/2002 | Sturman et al. |
| 6,474,304 | B1 | 11/2002 | Lei |
| 6,550,453 | B1 | 4/2003 | Tian |
| 6,766,792 | B2 | 7/2004 | Messinger et al. |
| 6,776,138 | B2 | 8/2004 | Mahr et al. |
| 6,830,202 | B2 | 12/2004 | Coldren |
| 2003/0178508 | A1 | 9/2003 | Coldren |

* cited by examiner

COMBUSTION CELL ADAPTED FOR AN INTERNAL COMBUSTION ENGINE

CROSS-REFERENCE TO RELATED APPLICATION

This application is a continuation of U.S. patent application Ser. No. 10/894,299 filed Jul. 19, 2004 now abandoned, which claims the benefit of U.S. Provisional Patent Application No. 60/488,604 filed on Jul. 17, 2003.

TECHNICAL FIELD

The present invention relates generally to internal combustion engines and, more particularly, to camless air and fuel injection controls adapted for an engine combustion chamber.

BACKGROUND ART

Intensifier-type fuel injectors are well known in the prior art. As an example, see U.S. Pat. No. 5,460,329 issued to Sturman on Oct. 24, 1995. That patent discloses an electromagnetically actuated spool valve for controlling the coupling of an effective area over an intensifier piston to an actuating or working fluid under pressure or to a vent, the intensifier piston driving a smaller piston to intensify the pressure of fuel for injection purposes. While various types of valves are known for use with such injectors, the valves generally control the flow of actuation fluid to and from the effective area over intensifier piston.

While control valves of the foregoing type can be made relatively small and fast acting, control of actuation fluid in this manner for direct fuel injection may have limitations. In particular, a diesel fuel injector may intensify fuel pressure to a pressure on the order of about 20,000 psi or higher, at which pressures the fuel will undergo substantial compression. This, in turn, means that there must be substantial actuation fluid flow into the chamber over the larger piston of the intensifier. In that regard, while, by way of an example, in an intensifier having a ratio of effective areas of 9:1, the pressure of the actuating fluid over the larger piston will only be ⅑ of the intensified pressure, the flow of actuation fluid required to achieve the compression and intensification of the fuel will be nine times that required because of the compression of the intensified fuel, thereby resulting in at least as much volumetric compression in the actuation fluid over the intensifier piston as in the intensified fuel. Consequently, intensification on actuation of the control valve(s) requires significant actuation fluid flow, and is therefore less than immediate. Also, this flow requirement sets the minimum size for the electrically operated control valves, and further requires de-intensification between injection events, making multiple injections during a single injection event difficult and energy consuming.

Known modular air and fuel controls adapted for an internal combustion engine are shown in U.S. Pat. No. 6,173,685 B1 issued to Sturman on Jan. 16, 2001 and U.S. Pat. No. 6,148,778 issued to Sturman on Nov. 21, 2000.

It is therefore desirable to provide a modular air-fuel control adapted for each engine combustion chamber that is capable of providing two stable engine valve lift (i.e., opened) positions and/or a selection of one, two or three injection pressure levels for injection fuel.

The present invention is directed to overcoming one or more of the problems as set forth above.

DISCLOSURE OF THE INVENTION

In one aspect of the present invention, there is disclosed a combustion cell adapted for an internal combustion engine, comprising i) a hydraulic engine valve actuation portion capable of providing two stable engine valve lift positions and ii) a fuel injection portion capable of providing a selection of one, two or three injection pressure levels for injection fuel.

The combustion cell provides more flexible control of incoming intake air, outgoing exhaust gas, and/or incoming injection fuel relative to an engine combustion chamber so as to better match engine operating conditions that may change over time.

BEST MODE FOR CARRYING OUT THE INVENTION

Referring to FIGS. 1–14, wherein similar reference numbers or characters designate similar elements or features throughout the Figs., there is shown exemplary embodiments of a combustion cell or improved air-fuel control module adapted for an internal combustion engine.

Figure 1:
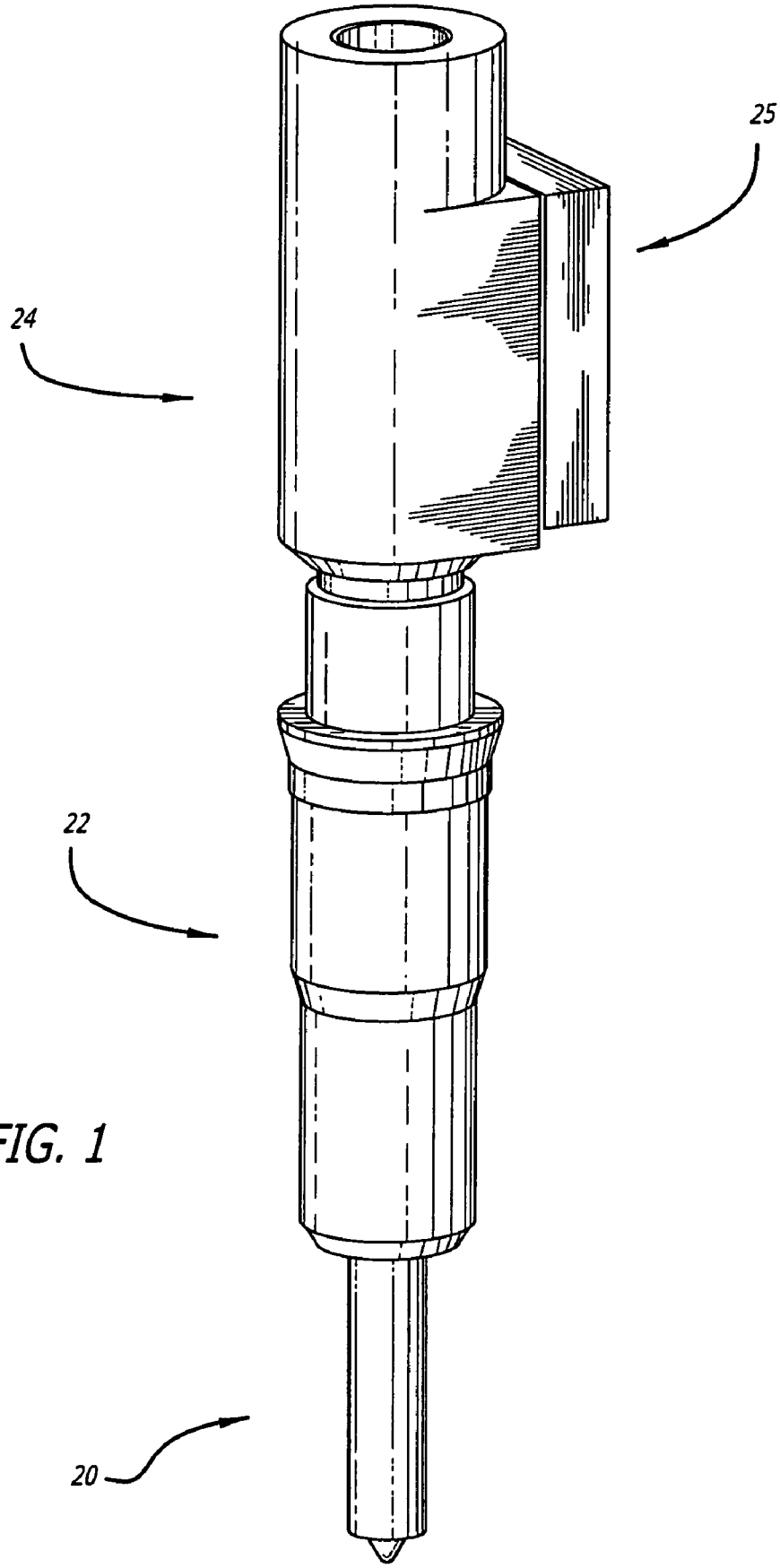
FIG. 1 is a perspective external view of an exemplary embodiment of a fuel injector in accordance with the present invention.

Thus, FIG. 1 is a perspective view of one embodiment of a fuel injector 10. The major parts of the fuel injector visible in this Figure are the injection tip, generally indicated by the reference numeral 20, a lower injector body assembly 22, and upper injector body assembly 24, and a control module 25.

Figure 2:
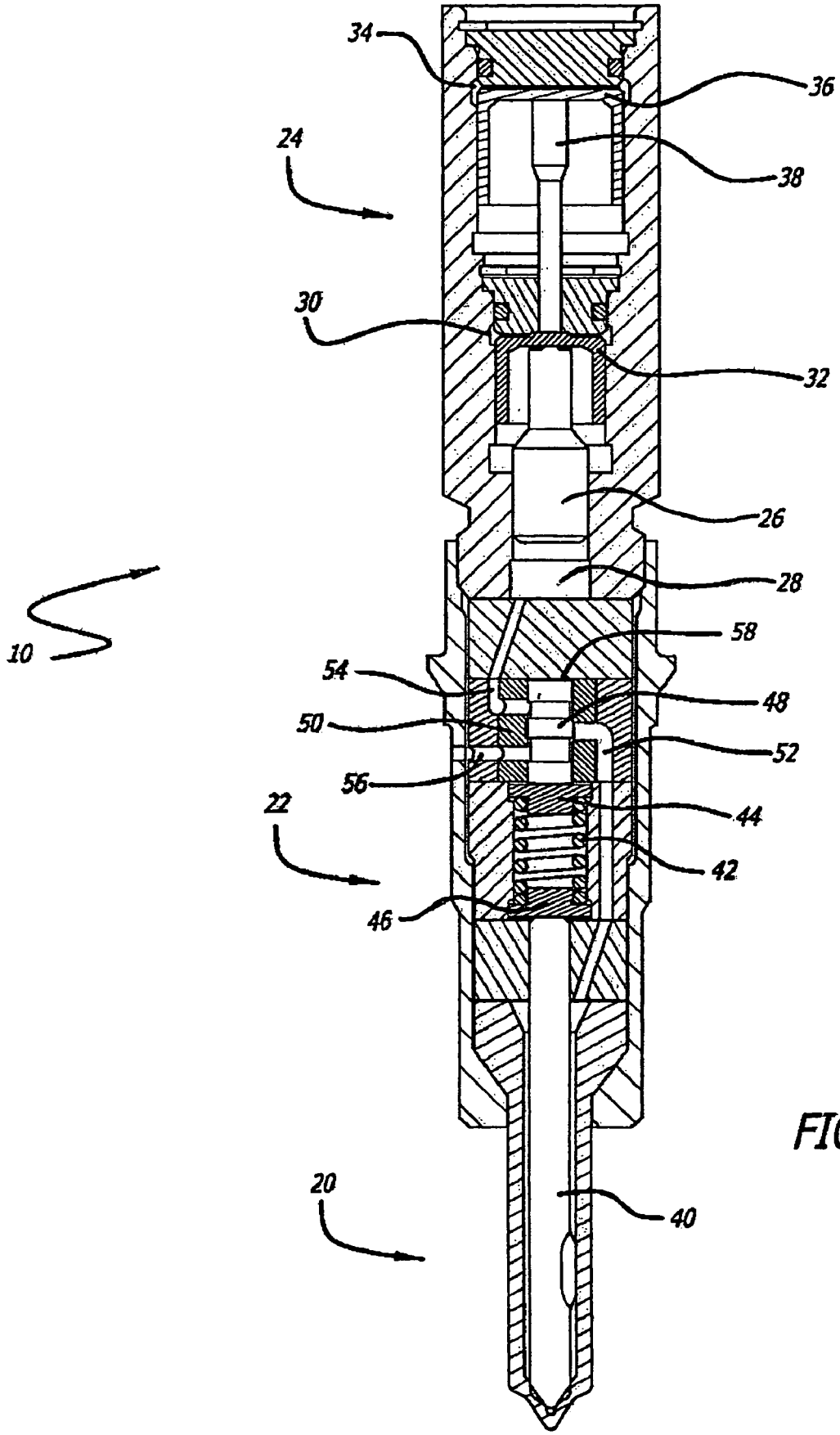
FIG. 2 is a cross-sectional side view of the injector of FIG. 1.

FIG. 2 presents a cross-sectional side view of the injector 10 of FIG. 1 illustrating the cooperation of the injection tip 20, the various parts of the lower injector body assembly 22 and the upper injector body assembly 24.

Figure 3:
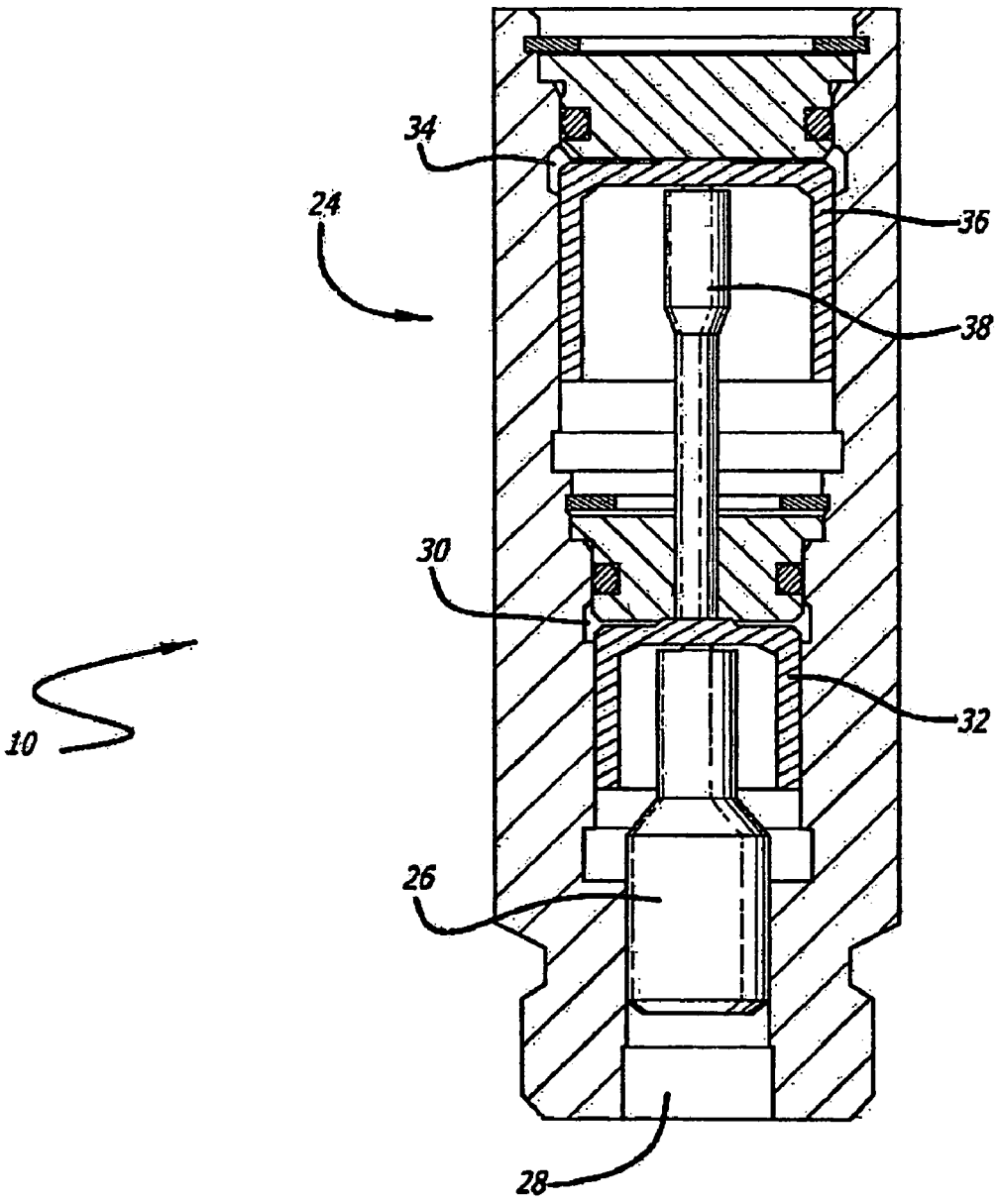
FIG. 3 is an enlarged view of an upper portion of the exemplary injector of FIG. 2.
Figure 4:
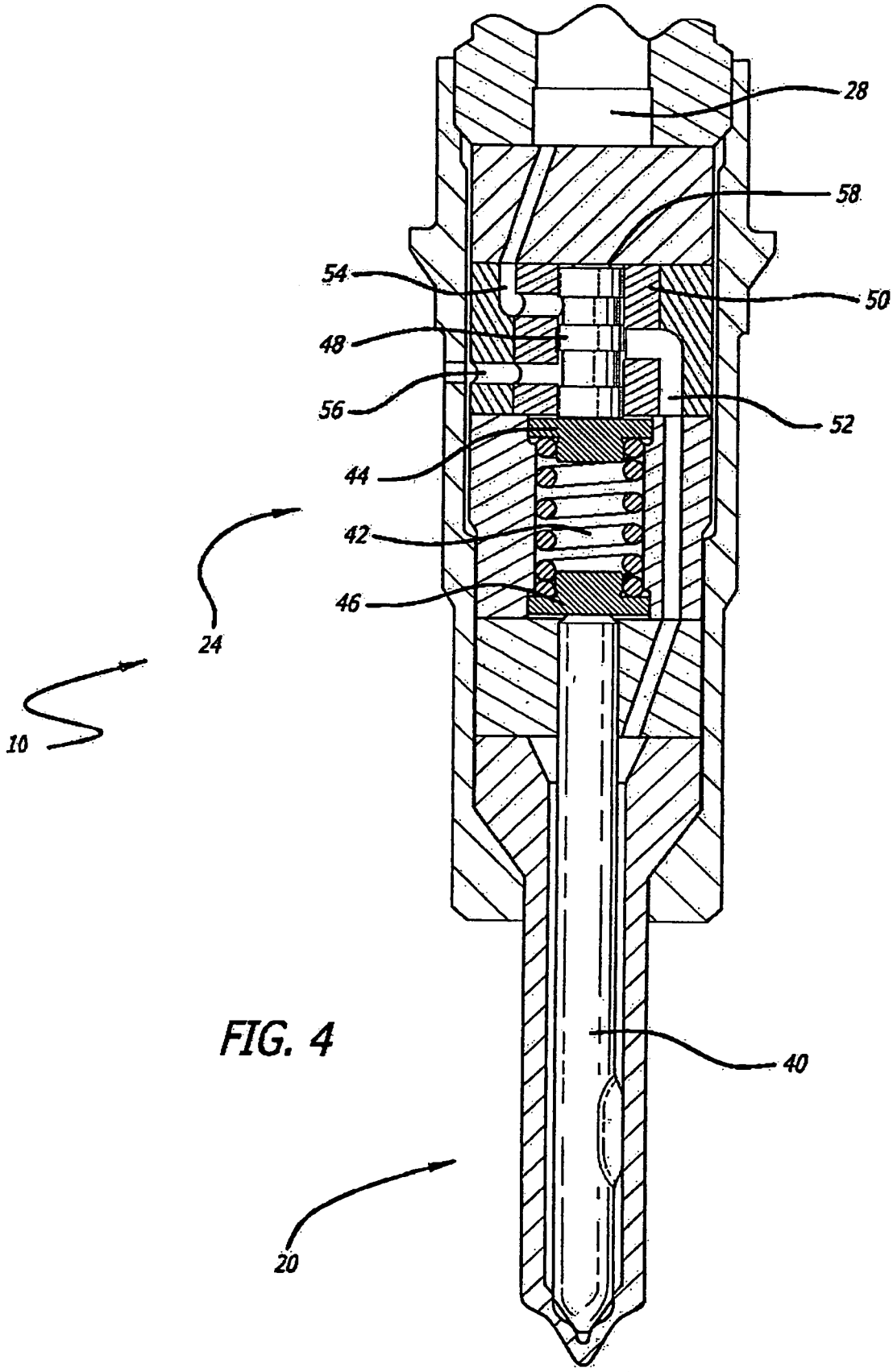
FIG. 4 is an enlarged view of a lower portion of the exemplary injector of FIG. 2.

FIGS. 3 and 4 show the same cross-sectional side views of the upper injector body assembly 24 and the lower injector body assembly 22, respectively, on a larger (but not the same) scale. As illustrated in FIGS. 2 and 3, the upper injector body assembly 24 is comprised of an intensifier piston 26 operative to provide a relatively higher or intensified pressure to the fuel in the intensifier chamber 28 in response to a downward force on the intensifier piston. The intensifier piston 26 may be driven downward by pressurizing the region or control volume 30 above piston 32, by applying actuating fluid pressure in region or control volume 34 above piston 36 operative against intensifier drive pin 38 or by applying actuating fluid pressure to both regions or control volumes 30 and 34. In an exemplary embodiment, the cross-sectional or effective area of piston 32 is approximately three times the cross-sectional or effective area of intensifier piston 26, with piston 36 having a cross-sectional or effective area approximately equal to six times the cross-sectional or effective area of intensifier piston 26. Thus, intensification ratios of approximately three (by pressurizing the region 30 over piston 32), six (by pressurizing the region 34 over piston 36) and nine (by pressurizing both of the regions 30,34 over the respective pistons 32 and 36) may be achieved. These numbers, of course, are exemplary only and any ratios may be used as desired. Alternatively, the control may be used to pressurize either one or the other but not both regions 30 and 34 at the same time, or by way of further alternative, the aspects of the prior invention inherent in the lower injector body assembly 22 and control may be practiced with simply a single intensifier actuation piston if desired.

Certain details of the upper injector body assembly 24 are not illustrated in FIG. 3, though the same are obvious design aspects that would be apparent to anyone of reasonable skill in the art. These, of course, include the porting for applying actuation fluid pressure to region 30 and/or to region 34, for venting the regions below intensifier actuation pistons 32 and 36 to avoid the possibility of a hydraulic lock, and the means to return the intensifier piston 26 and the actuation pistons to their upper position and replenish the fuel in the intensifier chamber 28 between injection cycles, whether by fuel supply pressure in the intensifier chamber, a return spring or something else.

Now referring to FIGS. 2 and 4, cross-sections of the lower injector body assembly 24 may be seen. The injection tip 20 is of a generally conventional design, the needle or check valve 40 therein being encouraged or biased downward to a check valve closed position by coil spring 42 operative against spring retainers 44 and 46. The upper spring retainer 44 is also in contact with the lower end of a three-way two-position spool 48 for a spool valve operative within a spool valve body 50. This spool valve either couples region 52 providing fuel under an intensified pressure to the internal region of injector tip 20 from port 54 coupled to the intensifier chamber 28 (see also FIG. 3), or couples region 52 through port 56 to a lower pressure vent or drain region. In the position shown, the spool valve member 48 is positioned within the spool valve body 50 to couple region 52 to the drain 57 so the fuel in the check valve region is not substantially pressurized.

Not readily visible in the cross-section of FIG. 4 is a porting of fluid typically under the same pressure as the intensifier actuation fluid pressure to the region 58 above the spool 48. As shall be subsequently described in detail, an actuation fluid under pressure is controllably applied to the region 58 above spool 48 to control the position of the spool. In particular, at the beginning of an injection cycle, in the embodiment being described, intensifier actuation fluid under pressure will be applied to region 30 over the actuator piston 32 (see FIG. 3), to region 34 over the intensifier actuation piston 36, or both regions 30 and 34, resulting in intensified fuel pressure in intensifier chamber 28 and, thus, port 54 (FIG. 4). Shortly thereafter, typically after the intensification pressure has been obtained, actuation fluid under pressure is applied to region 58 to move spool 48 to a downward position against the opposing force of spring 42, coupling the intensified fuel in port 54 through port 60 to region 52 to initiate injection through the needle or check valve 40 which, as a result of high pressure fuel, will move upward against coil spring 42 to initiate fuel injection.

Injection is terminated by first venting region 58 above spool 48, allowing coil spring 42 to move the spool to the position shown to terminate the supply of intensified fuel to the check valve 40, followed by the controlled venting of the pressurized region(s) above intensifier actuation piston or pistons 32,36 to allow the return of the intensifier piston to its starting position and the refilling of the intensifier chamber 28 with fuel under the effect of fuel supply pressure or the combination of fuel supply pressure and return spring (not shown). It should be noted that while in the exemplary embodiment the actuation fluid for the intensifier and for spool 48 is fuel, other actuation fluids such as engine oil may be used as desired.

Figure 5A:
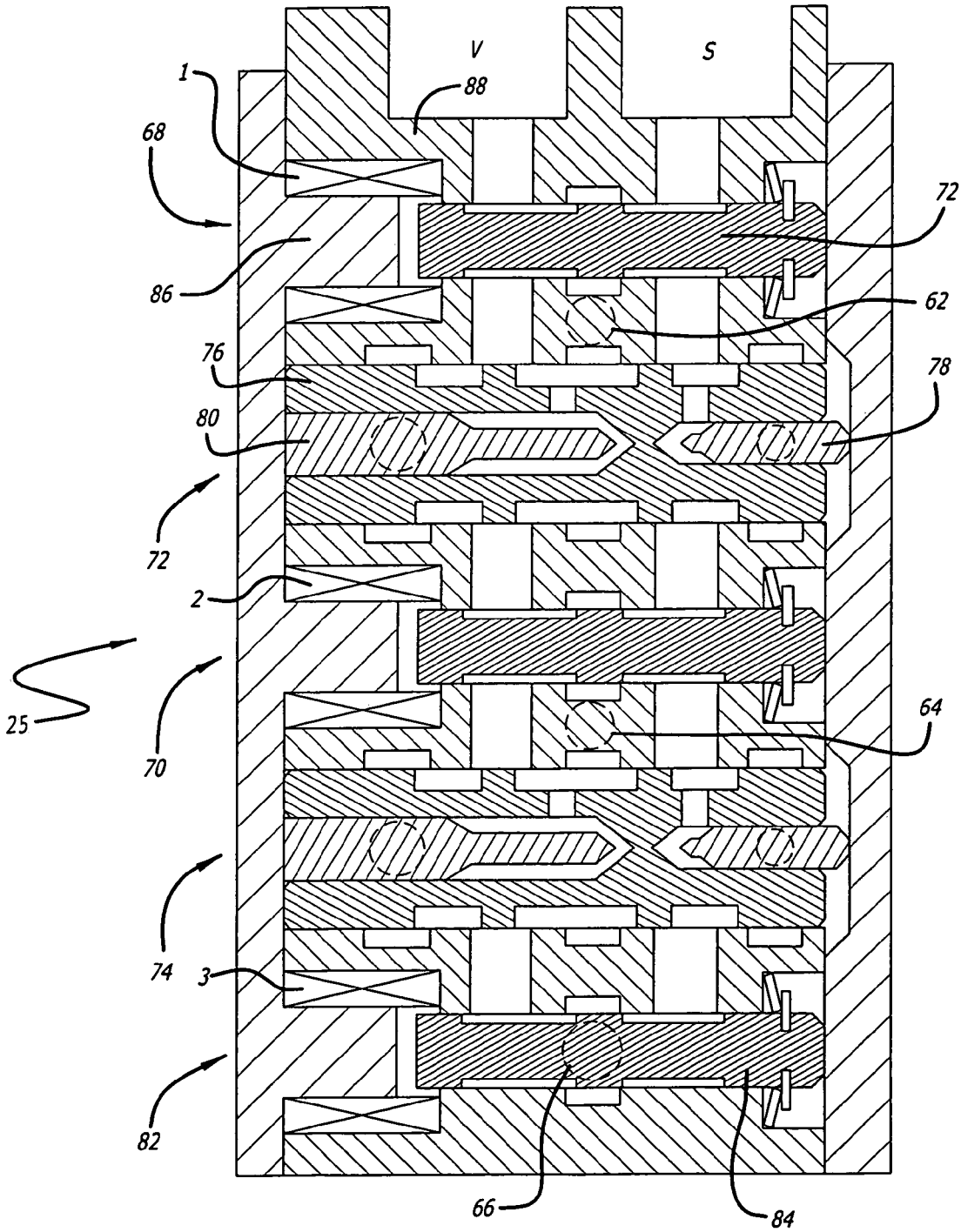
FIG. 5A is a cross sectional side view of an exemplary control module 25 for the exemplary injector of FIG. 1.

Now referring to FIGS. 1 and 5A, a sketch of an exemplary control module 25 may be seen. The major porting for the control module 25 includes an actuation fluid supply port S that supplies fluid under the actuation pressure to three solenoid or electromagnetically actuated pilot spool valves 68,70,82 and two main spool valves 72,74 to be described. The porting also includes a vent port V, also communicating with the three solenoid or electromagnetically actuated spool valves and the two main valves, and further includes three outlet passages 62, 64 and 66 coupled to the injector body assemblies hereinbefore described. Two of the solenoid or electromagnetically actuated spool valves, indicated by the numerals 68 and 70, indirectly control the coupling of ports 62 and 64, respectively, to the source S or vent V ports. The ports at 62 control the coupling of fluid to region 34 located over upper intensifier piston 36 (see FIG. 3), with port 64 controlling the coupling of actuation fluid to region 30 located over lower intensifier actuation piston 32. Since the spool valves 68 and 70 (FIG. 5) may be identical, details of only one will be described.

In particular, spool valve 68 is comprised of a solenoid or electromagnetic coil 1 controllably magnetizing a magnetic circuit which includes spool 69 of the spool valve, the spool 69 being encouraged or biased to the right-hand position by the spring washer 73 at the right-hand end of the spool and electromagnetically attractable to a left-hand position as desired. While the spool valve 68 in FIG. 5A is indicated as being a magnetically latching spool valve, magnetic latching with residual magnetism is not a necessity, as a non-magnetic latching spool valve may also be used if desired. Similarly, other return springs, opposing dual electromagnetic coil actuators, etc. may be used as desired, as the specific valves described are exemplary only.

Pilot valve 68 controls a main valve, generally indicated by the numeral 72, while spool valve 70 controls main valve 74. The main valves 72 and 74 may be substantially identical, both being spool valves in the embodiment shown. With respect to main valve 72, the right end of the spool 76 therein contains a small bore with sliding piston pin 78 therein which is pressurized on the left end by the pressure of the fluid in the supply port S and is vented at the right end. At the left end of spool 76 is another piston pin 80 (having a relatively larger effective area) within a corresponding larger bore in the spool 76, with the right end of pin 80 being coupled either to the supply port pressure or the vent pressure as controlled by the position of spool 72 in pilot valve 68. Thus, the spool valve 68 controls the position of spool 76, allowing a small spool valve 68,72 with a very short stroke to cause a longer stroke in a somewhat larger diameter spool valve 72,74 to control a relatively large fluid flow area by a relatively small pilot spool valve. The position of spool 76 in turn controls the coupling of port 62 to the intensifier actuation fluid supply or the vent, port 62 being coupled to region 34 above intensifier piston 36. Similarly, pilot valve 70 controls main valve 74 and, thus, the coupling of port 64 to the intensifier actuation fluid pressure or vent in a similar manner.

Finally, a third pilot spool valve, generally indicated by the numeral 82, controls the position of spool 84 which in turn controls the coupling of port 66 to the actuation fluid supply S or vent V, depending on the position of the spool. Port 66 is coupled to the region 56 (FIG. 4) over spool 48 to control the coupling of fuel under the intensified pressure to the check valve 40. The spool 48 of this valve, when in the unactuated position, should preferably couple the check valve fluid to vent, not to the supply pressure, as a failsafe feature, and for the same reason, preferably the spool of this valve is not magnetically latching, the return spring 42 overcoming the inherent magnetic force caused by the residual magnetism in the magnetic circuit, including the spool 48.

The advantage of the assembly hereinbefore described is that the speed with which actual injection may be initiated and terminated is extremely high, as it is controlled by a small spool valve 82 controlling a small fuel injection fluid flow as opposed to the flow of intensifier actuation fluid that is many times higher. Thus, while the two-stage control for the selective application of intensifier actuating fluid to one or both of the regions 30,34 located over respective intensifier pistons 32,36 may be substantially slower, that does not affect the speed of initiation or termination of injection. In that regard, the prior invention is fast enough to use multiple injections of small quantities of fuel for pilot-injection purposes and/or for extending the overall injection period for such purposes as engine operation under low load and/or lower engine speed operation using a single intensification cycle, and in fact, the intensified pressure of the fuel may be changed during the multiple injections by control of valves 68 and 70 during or between those injections. Thus, pilot injection may be at one fuel pressure, and the subsequent injection or injections at a different pressure, typically but not necessarily a higher pressure. In an exemplary embodiment, the control module of FIG. 5A measures approximately 1 inch wide by 2 inches high by ½ inch thick.

Thus the injector 10 adds control of fluid pressure over the needle 40 by including an additional valve mechanically coupled, in many embodiments actually integral with, the spool 48. This provides substantially simultaneous shifting between a) pressure over the "top" of the needle and "vent" pressure at the lower end of the needle, and b) vent pressure over the top of the needle and fuel at an intensified pressure for injection at the bottom of the needle.

Figure 5B:
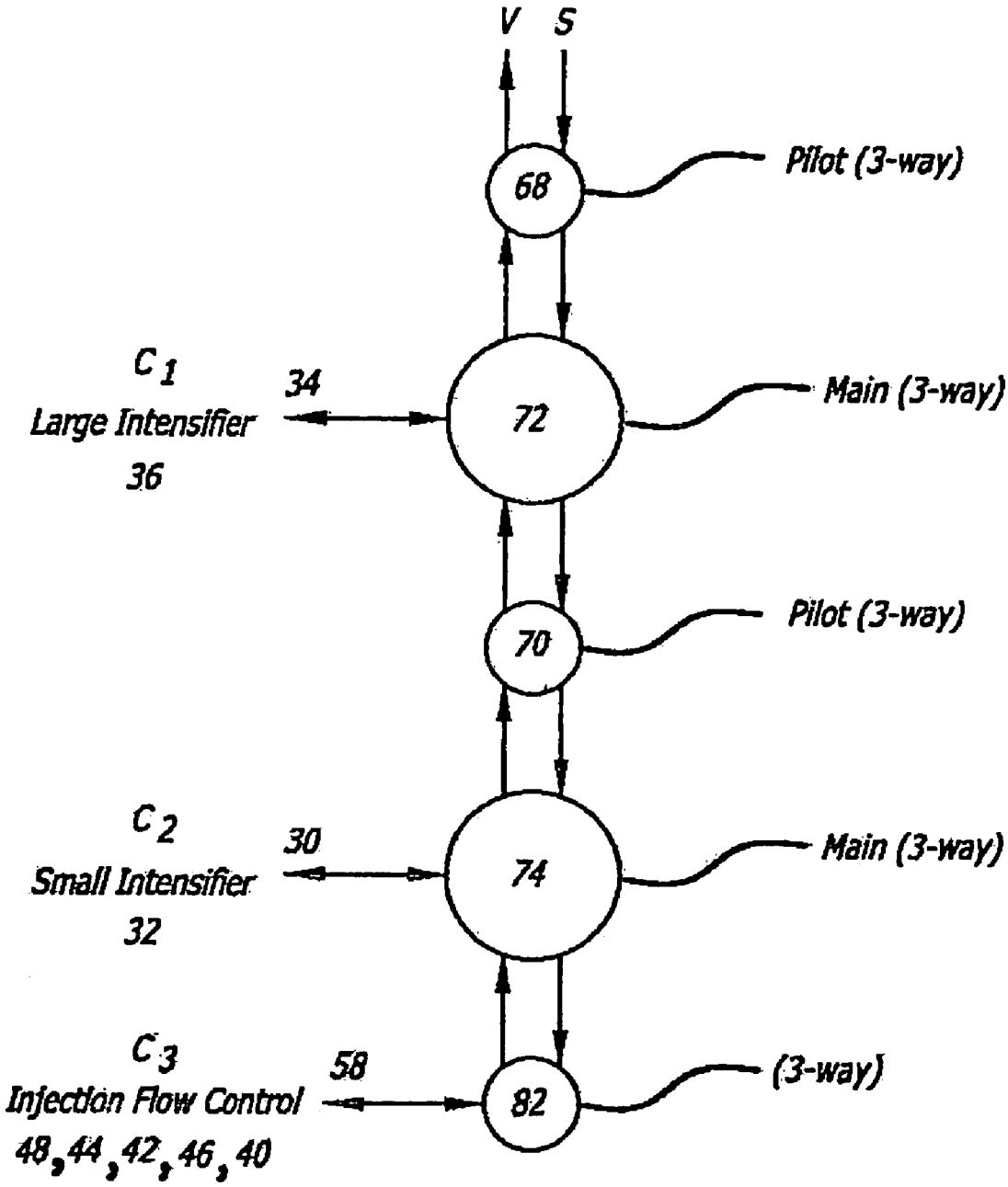
FIG. 5B is a control fluid flow diagram for the exemplary control module of FIG. 5A.

FIG. 5B provides a simplified diagram of the control module of FIG. 5A. As may be seen therein, in this exemplary embodiment, the supply and vent ports are coupled to all five valves. The upper pilot valve, which in this embodiment is a 3-way spool valve, controls the upper main 3-way main spool valve controlling the large intensifier 36, the next pilot valve, which in this embodiment is also a 3-way spool valve, controls the upper main 3-way main spool valve controlling the small intensifier 32, with the bottom valve, which may be the same as the pilot valves, controls the injection flow control valve. Preferably the injection flow control valve is not magnetically latching as a fail safe feature, though the pilot valves may be non latching also to remove intensified pressure from the actual intensified fuel flow control spool valve spool 48.

Other embodiments disclosed herein add control of fluid pressure over the needle 40 by including an additional valve mechanically coupled, in many embodiments actually integral with, the spool 48. This provides substantially simultaneous shifting between a) pressure over the "top" of the needle and "vent" pressure at the lower end of the needle, and b) vent pressure over the top of the needle and fuel at an intensified pressure for injection at the bottom of the needle.

Figure 6:
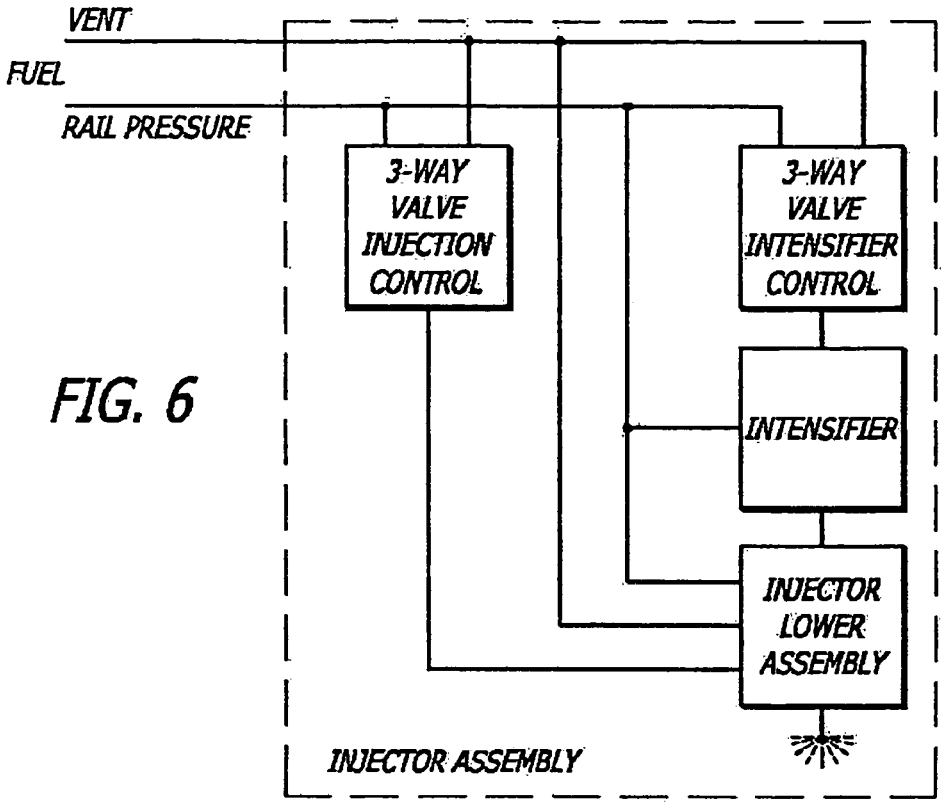
FIG. 6 is a block diagram for an injector assembly wherein the intensifier is hydraulically powered by the fuel supply rail pressure and controlled through a two-position three-way intensifier control valve and wherein the needle valve of the injector lower assembly is controlled by a two-position three-way injection control valve.
Figure 7:
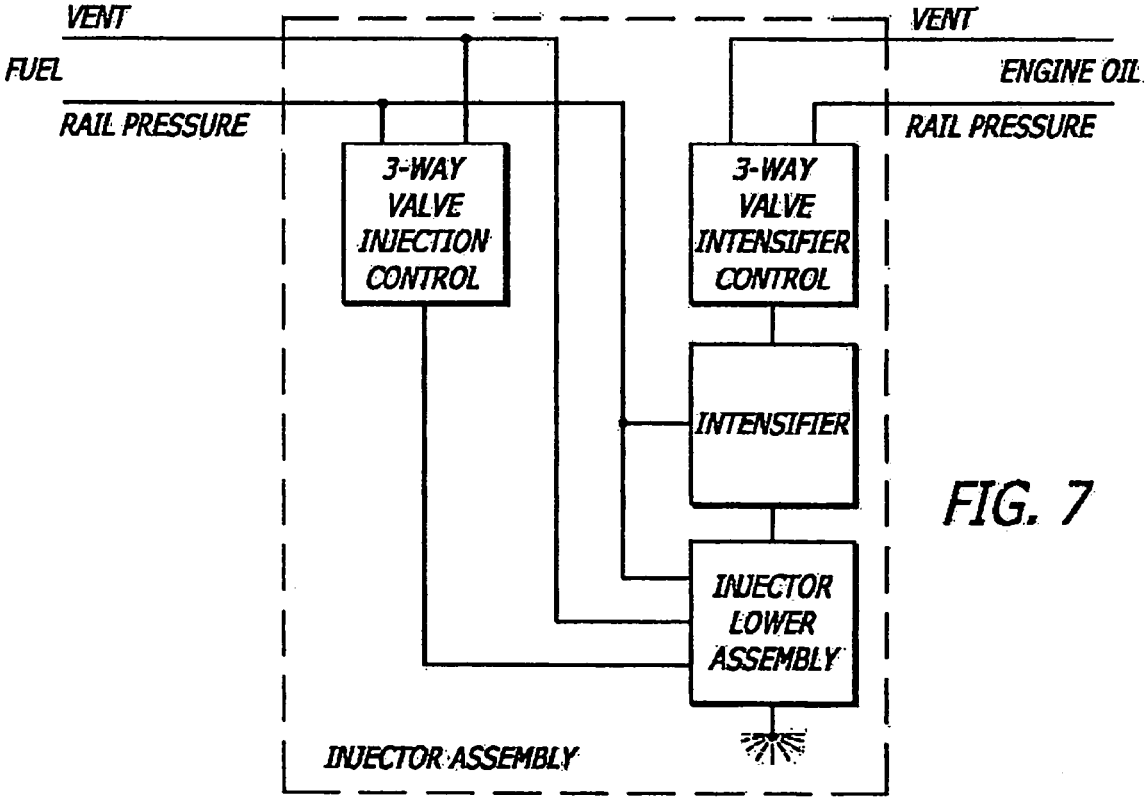
FIG. 7 is a block diagram for an injector assembly similar to the embodiment of FIG. 6 except that the intensifier is hydraulically powered by pressurized engine oil rather than fuel.

Before going into the detailed operation of the injector, block diagrams of embodiments of such overall injector assemblies may be seen in FIGS. 6 and 7. FIG. 6 provides a block diagram for an injector assembly wherein the intensifier is powered by the fuel rail pressure through a three-way intensifier control valve. Similarly, a three-way injection control valve is used to control the coupling of rail pressure or a vent to the hydraulically controlled needle control valve in the lower assembly of the injector. Either or both of these control valves may be in other forms as desired, such as by way of example, either or both of the valves, as in the earlier embodiments, may be a pair of two-position two-way valves, preferably solenoid or electromagnetic operated spool valves using one or two actuator coils, with or without magnetic latching. The control valves may be single actuator spring return or double actuator, either of which may or may not include magnetic latching, though other variations of valves, including other variations of spool valves, may be used as desired.

The embodiment of FIG. 7 is similar to that of FIG. 6, though the intensifier in this embodiment is powered by engine oil under pressure rather than fuel. If desired, the valve in the lower assembly of the injector could also be powered by engine oil under pressure, though this is not preferred. In any event, in the description to follow, as well as in the prior embodiments, either actuating fluid will simply be referred to as actuating fluid, whether by way of example, the actuating fluid is fuel rail pressure or engine oil rail pressure. The vent pressure may be atmospheric pressure or some other pressure, frequently a pressure somewhat above atmospheric pressure.

Figure 8:
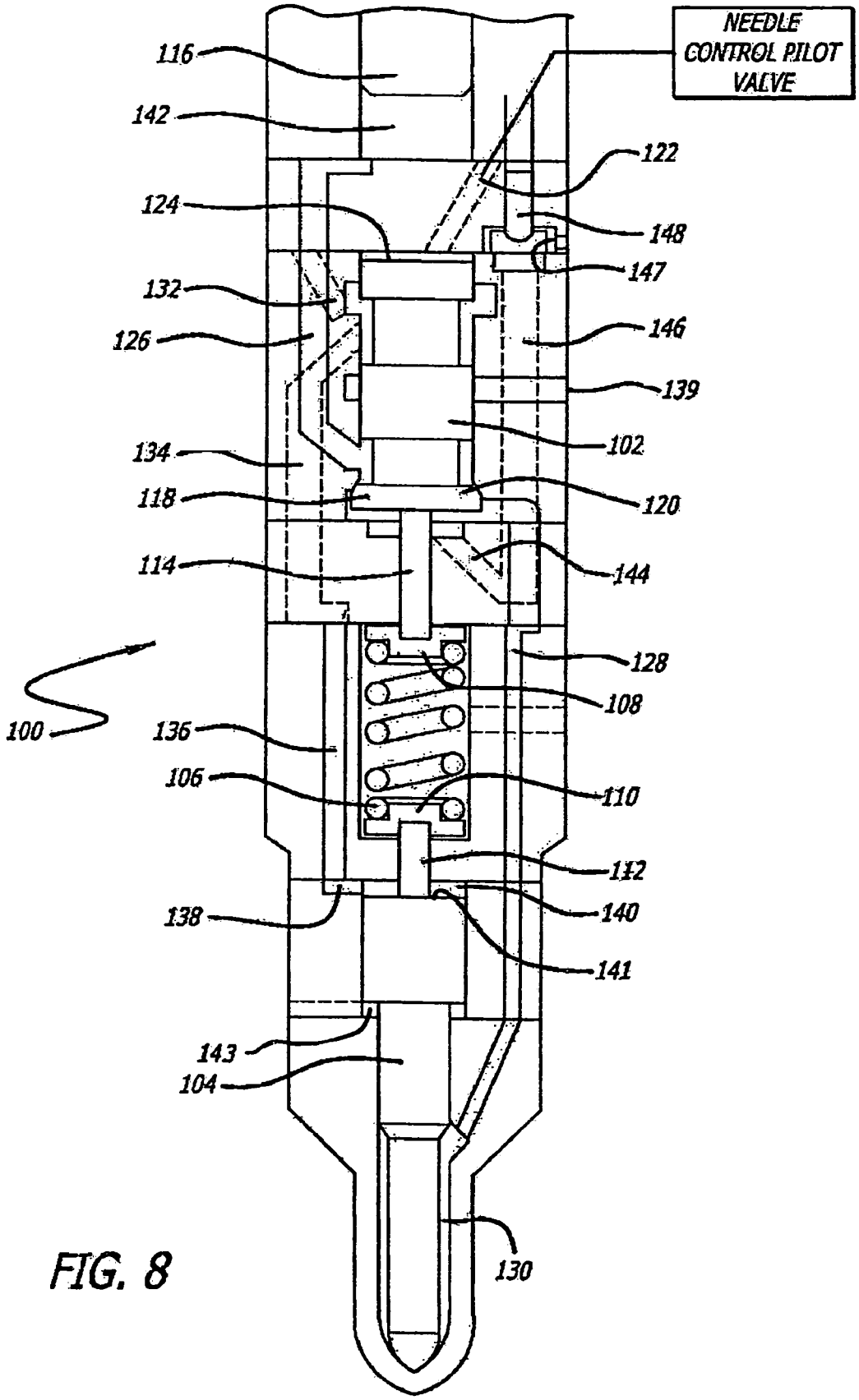
FIG. 8 is a cross sectional side view similar to FIG. 4 but showing an alternative embodiment of a lower injector assembly of the present invention.

Now referring to FIG. 8, a cross section of the lower injector assembly in accordance with an embodiment of the present invention may be seen. This embodiment includes within the lower injector assembly, generally indicated by the numeral 100, a spool 102, a needle 104, coil spring 106 with spring retainers 108 and 110, and pins 112 and 114. Also visible in FIG. 8 is intensifier piston 116, which may be powered by fuel at rail pressure or engine oil under pressure, as controlled by electronically controlled valving as is now well known in the art. With no fluid pressure (i.e., neither fuel supply rail pressure nor intensified fuel pressure) in the injector 10, coil spring 106 pushes down on spring retainer 110, thereby pushing pin 112 against the top of needle 104 to hold the needle closed. At the same time, the coil spring 106 pushes upward on spring retainer 108 against pin 114, which in turn pushes spool 102 upward to its maximum upward position. In that regard, end 118 of spool 102 is relatively larger than the diameter of the rest of the spool, and acts as a poppet valve to seal against valve seat 120 in the body of the injector, the two-way two-position poppet valve hereafter being referred to as poppet valve (118,120).

In operation, the position of spool 102 is controlled by controllably coupling passage 122, and thus chamber 124 over the top of spool 102, to either rail pressure or a vent pressure. This is provided by a three-way needle control pilot valve, preferably a spool valve (not shown in the Figure) that may be of any of various types well known in the art. With passage 122 coupled to vent, the spool will be in its upper position because of spring 106 pushing upward on spring retainer 108 and in turn, on pin 114 pushing against the lower end of the spool. (The chamber in which the spring 106 resides is vented.) In this position, fuel in passage 126 coming from the intensifier chamber 142, whether at an intensified pressure or approximately rail pressure during the intensifier return, is blocked by the poppet valve (118,120) from flowing through passage 128 to the lower needle chamber 130. At the same time, rail pressure is coupled from passage 132 through the spool valve 102 and passages 134, 136 and 138 to chamber 140 over area 141 on the top of the needle 104 to hold the needle closed (down), the compliment or underside 143 of area 141 being vented.

When the needle control pilot valve is in a position to couple rail pressure through passage 122 to chamber 124 over the spool 102, the spool 102 will move downward to its lower position, closing fluid communication between passage 132 and 134, and coupling passage 134 to the vent 140. It also closes communication between passages 144 and 128, and opens the poppet valve (118,120), coupling intensifier chamber 142 to the lower needle chamber 130 through the passages 126 and 128.

Consequently, for an injection event, an intensifier control valve means, which can be a 3-way intensifier control spool valve, can be actuated to couple rail pressure to the intensifier to intensify the fuel pressure, followed by actuation of the needle control valve to couple the intensified fuel to the lower needle chamber to initiate injection. Injection may be terminated by movement of the needle control valve and the intensifier control valve to the opposite states, preferably but not necessarily by first movement of the needle control valve 82, followed substantially immediately by movement of the intensifier control valve 68,70, to the opposite states. This also opens fluid communication between passages 144 and 128. Passage 144 is coupled to passage 146 having a valve at the top thereof coupled to a vent and encouraged or biased to the closed position by rail pressure on pin 148 acting on a seat at the top of passage 146. This sets a lower fluid pressure limit for the lower needle chamber 130, preferably to some fraction of the rail pressure.

In the foregoing embodiment, if multiple injections are to be used, such as, by way of example, a pre-injection followed by one or more main injection, the intensifier control valve may be actuated to intensify the fuel pressure, with the needle control valve being actuated multiple times during a single actuation of the intensifier control valve to provide the desired multiple injections without requiring the time and energy that would be associated with multiple pressure intensification cycles. Also, while the embodiment of FIG. 8 uses a poppet valve for coupling the intensified fuel to the lower needle chamber 130, a spool valve on spool 102 may also be used for that purpose.

Figure 9:
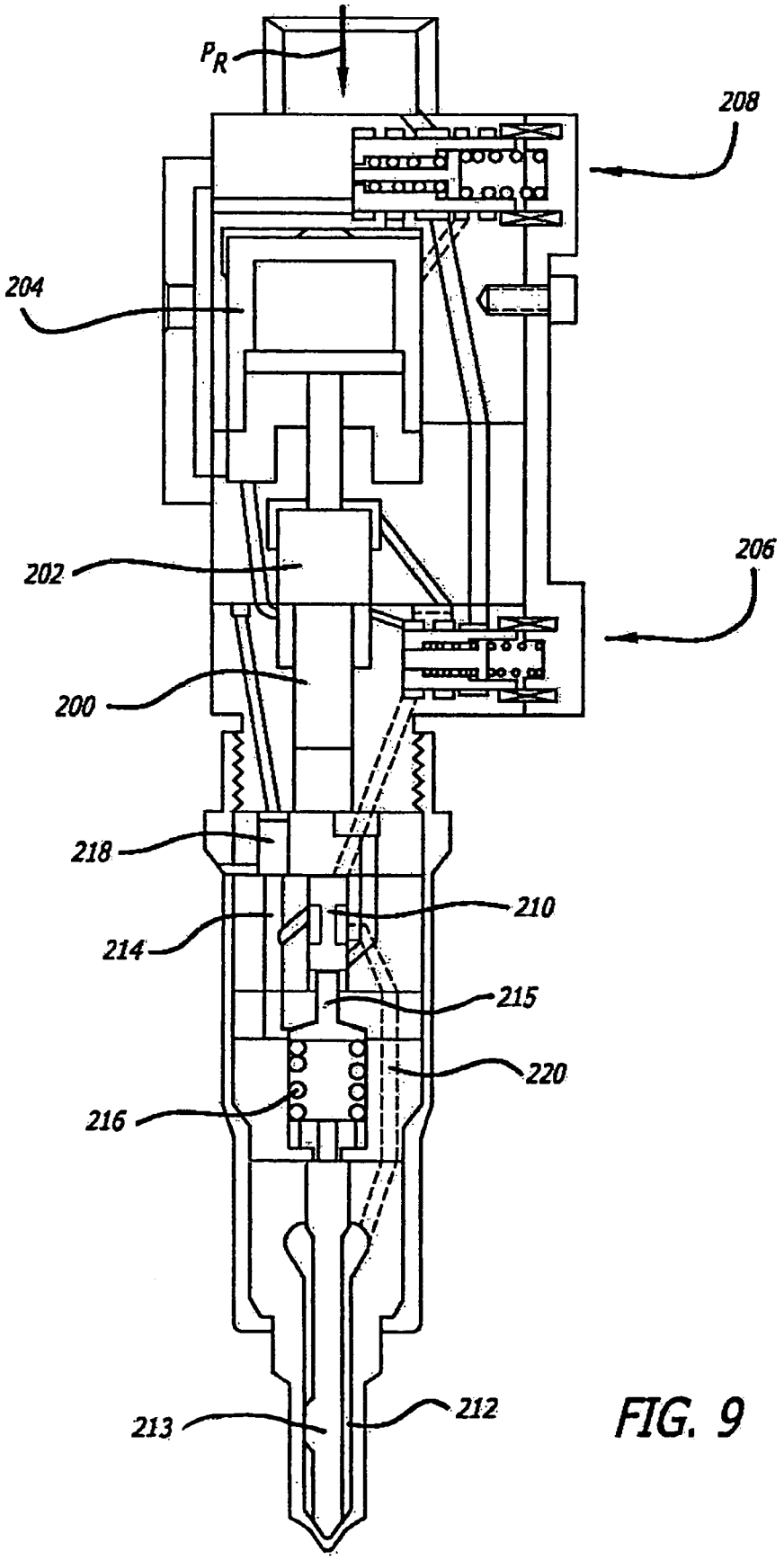
FIG. 9 is a cross sectional side view of another alternative injector in accordance with the present invention having multiple intensifier pistons.

In addition, the intensifier itself may have a single or a multiple, typically a dual, intensifier piston, that is, may be comprised of one or two driving pistons of equal or preferably unequal effective areas, preferably concentric or coaxial, each controlled by its own pilot control valve so is to be capable of achieving any of multiple intensified fuel pressures. In the embodiment of FIG. 9, intensifying piston 202 might be given an effective area approximately three times that of the intensifier piston 200, with intensifying piston 204 having an effective area approximately six times that of intensifier piston 200. Thus, intensification ratios of 3, 6 and 9 may be achieved by actuation of either or both control valves 206 and 208.

In the embodiment of FIG. 9, control valve 206 also controls spool 210, schematically illustrated, so that actuation of the intensifying piston 202 substantially simultaneously couples the intensified fuel through valve 210 to the lower needle chamber 212 to initiate injection. Injection is terminated by putting control valve 206 in the opposite state, blocking intensified fuel from the lower needle chamber 212 and coupling the lower needle chamber to a vent or relief valve through passage 214. In this embodiment, pin 215, subjected to rail pressure on the top thereof, provides a 2 to 1 relief ratio, so that the minimum pressure in the lower needle chamber 212 between injection events will be approximately twice rail pressure. The effective areas or ratios of effective areas may be set so that the residual pressure in the lower needle chamber 212 between injection events, together with coil spring 216, will provide an upward force that is less than the downward force provided by rail pressure acting on the cross-sectional or effective area of the spool 210.

The advantage of the embodiment of FIG. 9 is that through the use of only two electronically controlled control valves 206,208, needle control and injection flow control are achievable, as are three intensification pressure ratios of 3, 6, and 9 (or whatever ratios one chooses to use). The disadvantage, of course, is that needle control and flow control are integral with the lower intensification ratio control. This may be satisfactory in many applications, however, as for instance, one might provide pilot injection through the control of control valve 206 only, with control valve 208 being actuated after pilot injection but before main injection, so that substantial intensification is achieved before main injection is initiated. In other embodiments, a third control valve may be provided to decouple the needle control and injection flow control from the operation of either intensifier piston.

Figure 10A:
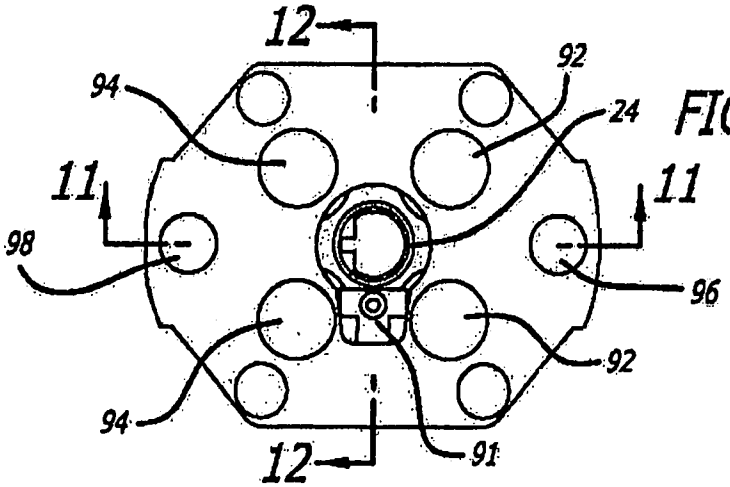
FIGS. 10A through 10C show top, front, and side views of an embodiment of a combustion cell of the present invention.
Figure 10B:
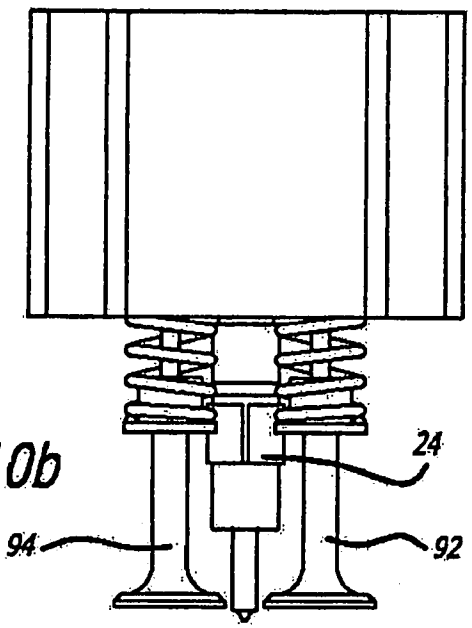
Figure 10C:
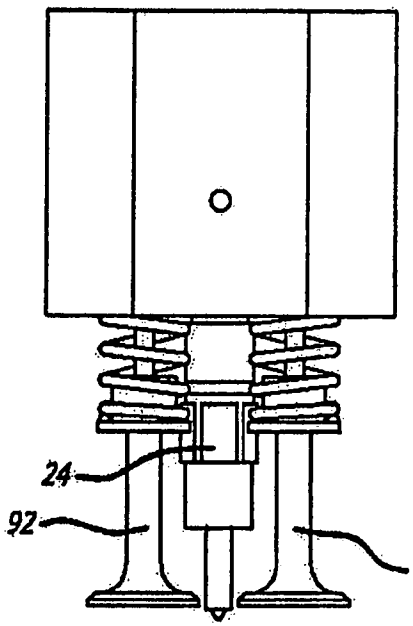

FIGS. 10A, 10B and 10C generally show a top, front, and side views of a combustion cell or air-fuel module of the present invention. The combustion cell may include a fuel injector 91, hydraulically actuated engine intake valves 92 and engine exhaust valves 94, and the hydraulic control valves 96 and 98 to control the actuation of the engine valves. The disclosed fuel injector may be used in such a combustion cell, as the compact arrangement of the fuel injector control valves may allow the intake and exhaust valves to be positioned in close proximity to the fuel injector.

Figure 11:
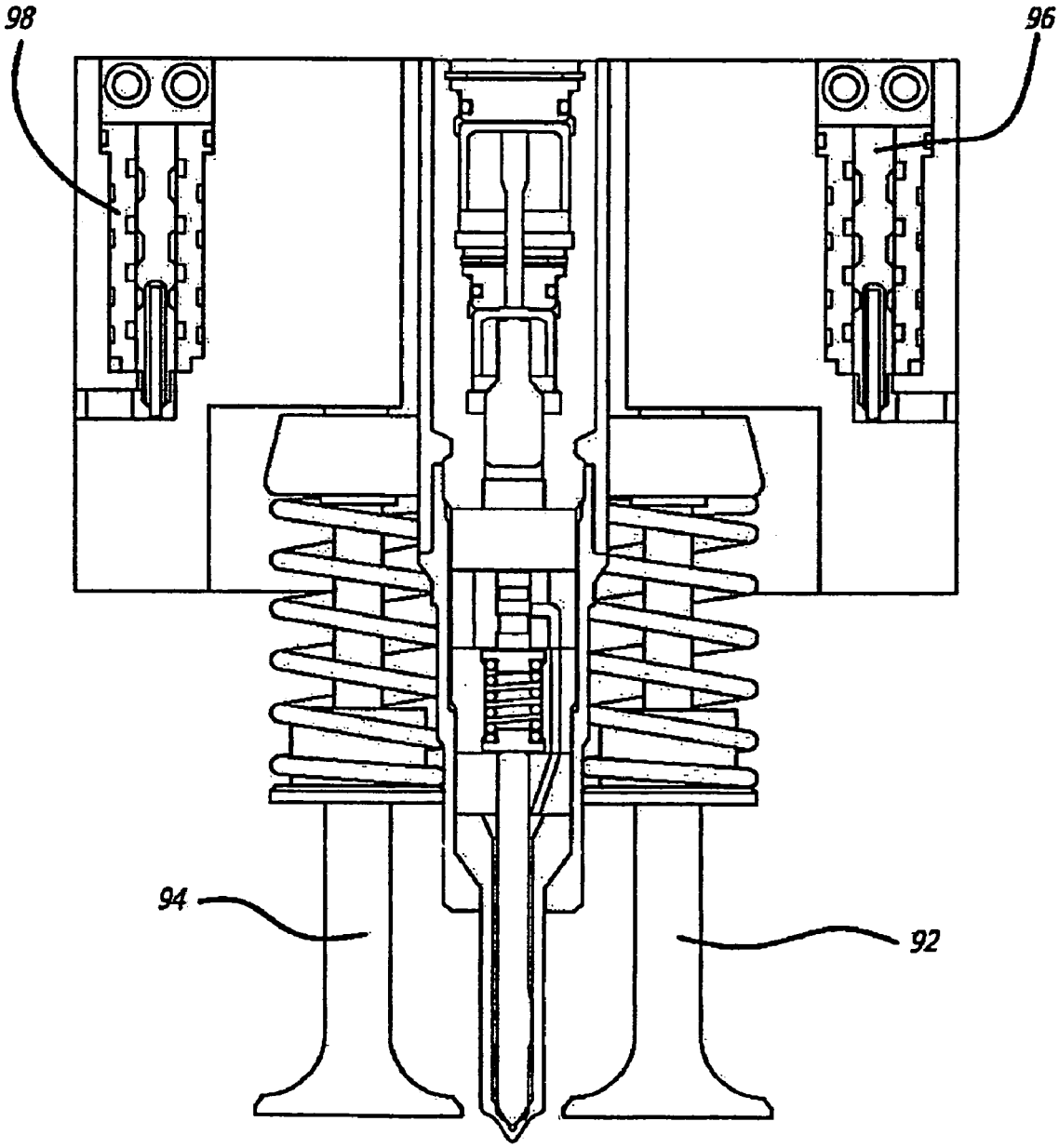
FIG. 11 shows a cross-sectional view of the combustion cell through section line 11—11 of FIG. 10A.
Figure 12:
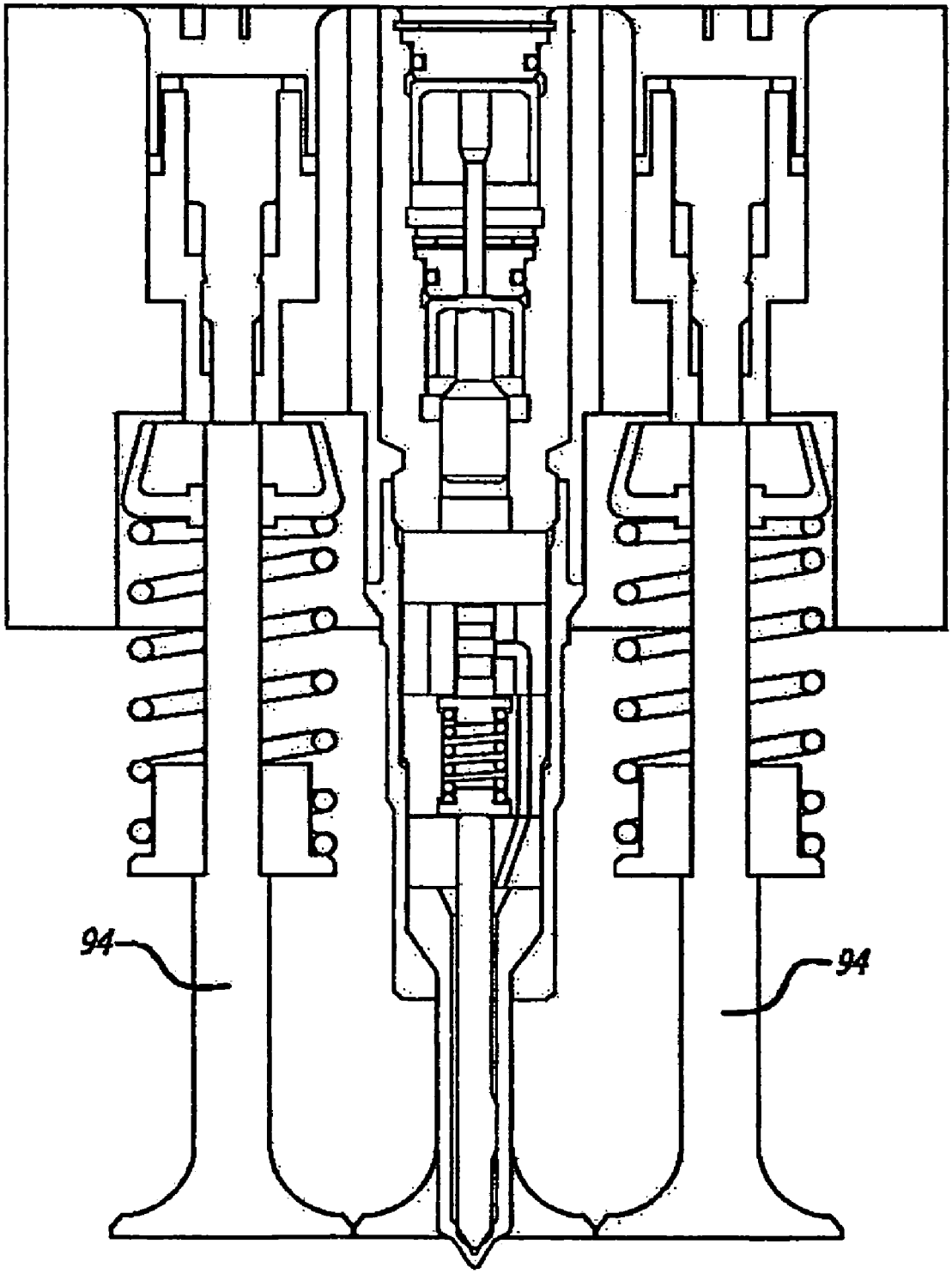
FIG. 12 shows a cross-sectional view of the combustion cell through section line 12—12 of FIG. 10A.

FIG. 11 shows a section view of the combustion cell through section line 1—1 of FIG. 10A. FIG. 12 shows a section view of the combustion cell through section line 2—2 of FIG. 10A. The fuel injector and valves are shown relatively schematically, the Figures being presented to illustrate the suitability of the present combustion cell invention to such applications.

Figure 13:
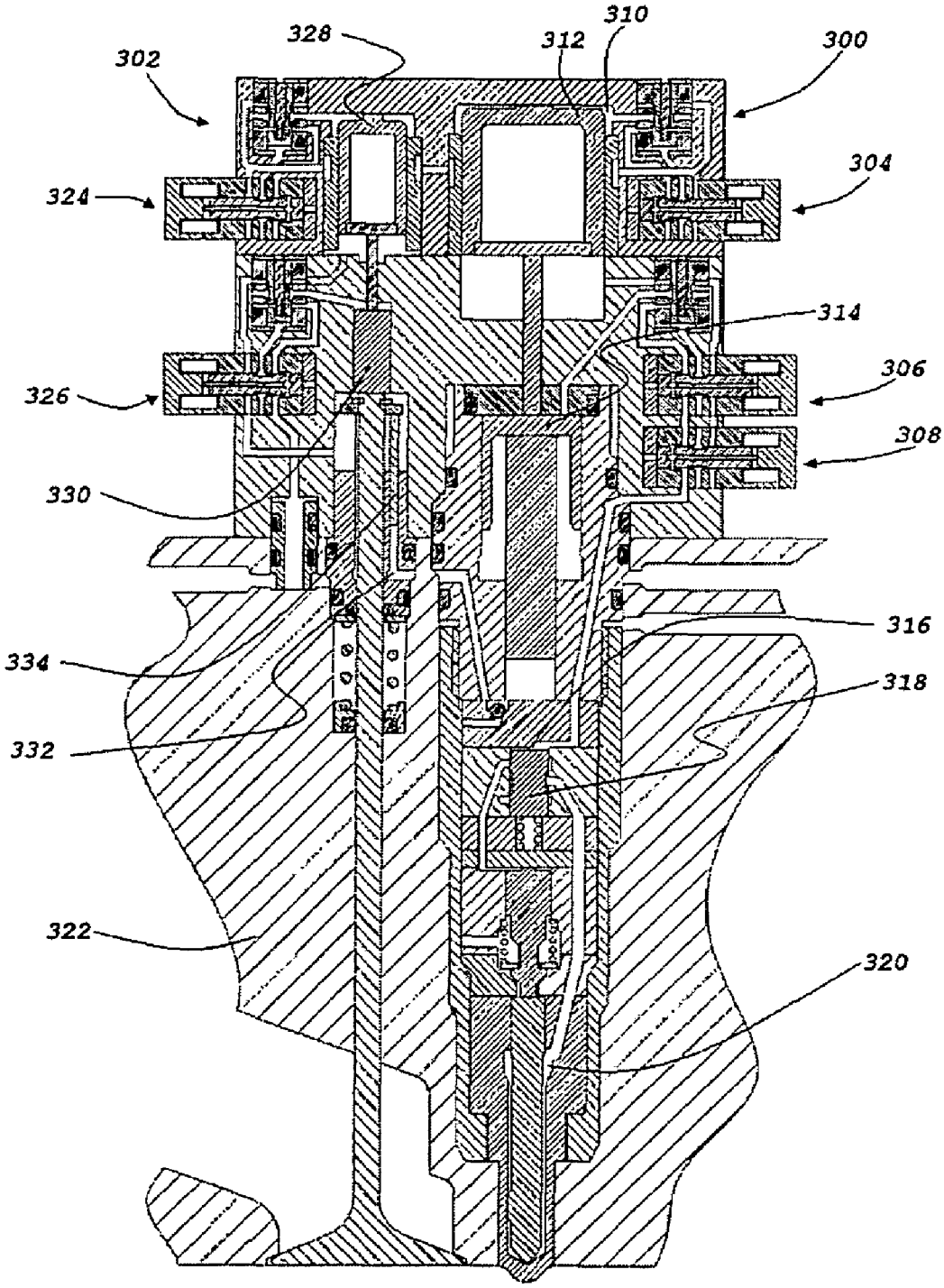
FIG. 13 shows a cross-sectional view of an alternative embodiment of the combustion cell of the present invention.
Figure 14:
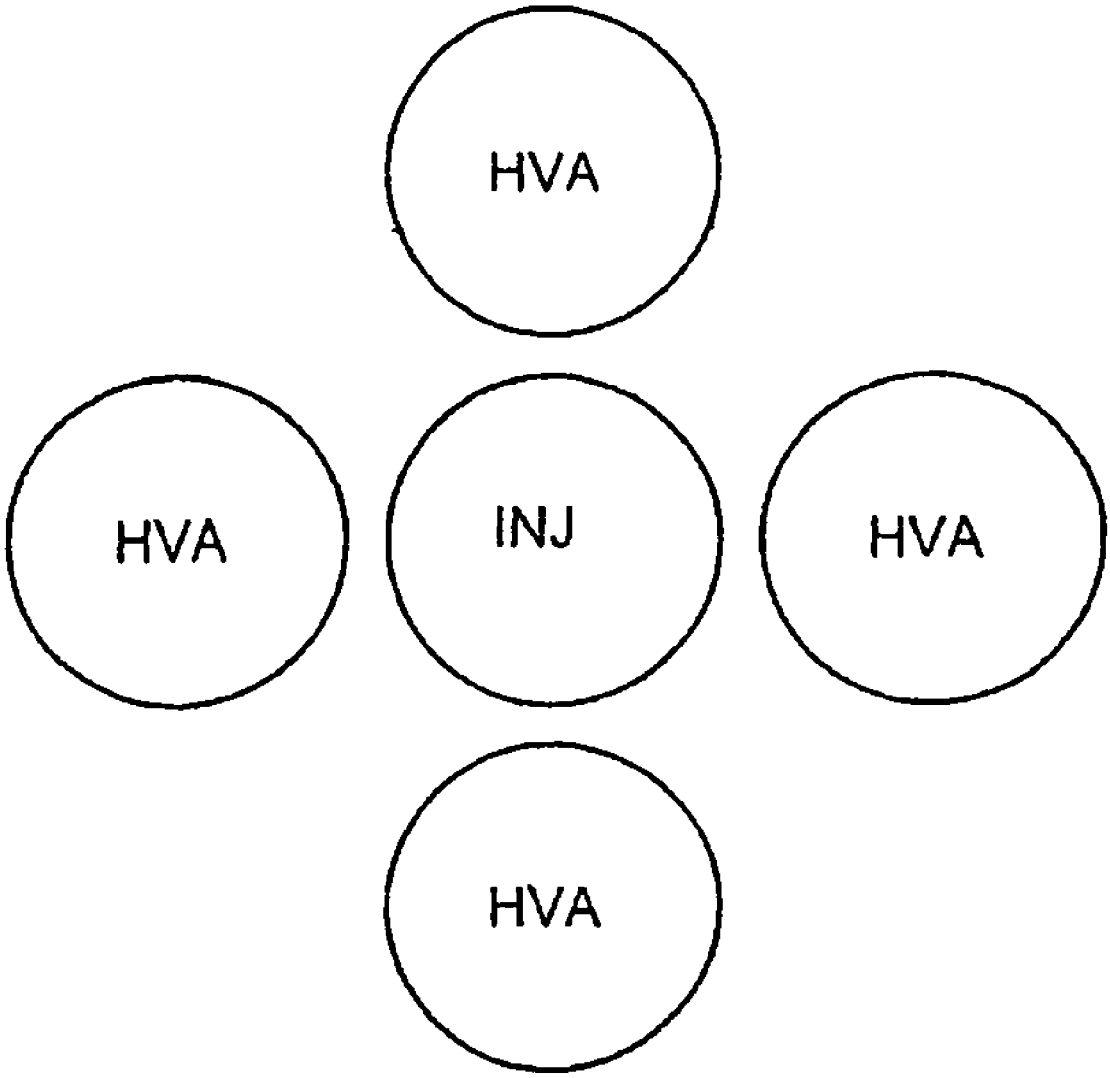
FIG. 14 shows a top view of an exemplary combustion cell of the present invention.

Now referring to FIG. 13, a partial cross-section of the combustion cell of the present invention may be seen. FIG. 13 depicts a fuel injector, generally indicated by the numeral 300, and a hydraulic engine valve actuator, generally indicated by the numeral 302. In a complete system as depicted in FIG. 14, the fuel injector INJ is encircled by four hydraulic valve actuators HVA, two of which are operative to each control a respective one of a pair of engine intake valves, and two of which are operative to each control a respective one of a pair of engine exhaust valves, the four valves all being associated with the same cylinder of a single or multiple cylinder engine. The injector 300 may be any of the injectors hereinbefore described, or of some other type.

The specific injector shown in FIG. 13 uses three solenoid or electromagnetically operated spool valves, generally indicated by the numerals 304, 306 and 308. Spool valve 304 controls the porting of chamber 310 over the large intensifier piston 312 to rail pressure or to a vent. Spool valve 306 controls the porting of the chamber over the small intensifier piston 314 to rail pressure or vent, and spool valve 308 controls the porting of chamber 316 over the spool 318 controlling the coupling of fuel at the intensified pressure to the lower needle chamber 320. Spool valves 304, 306 and 308 are preferably two-position three-way spool valves with single solenoid or electromagnetic actuation and spring return, though valves of other configurations, such as opposing dual solenoid or electromagnetic actuated spool valves, with or without residual magnetic latching, could be used. In the specific valves shown, two return springs are used, both of which preferably have a substantial preload. The first spring is active throughout the spool travel for encouraging the spool to the unactuated position and retaining the spool at that position. The second spring also acts as a return spring, though is active only over a fraction of the spool travel from the actuated position toward its unactuated position. This second spring acts to absorb a substantial amount of the spool kinetic energy during the final actuation travel, and to return that energy to the spool when actuation electrical current to the actuator coil is terminated to provide a form of snap action for the spool return. Thus, the second spring may allow the use of a relatively weaker first return spring, thereby decreasing the valve actuation time and tending to debounce the spool at its final actuation travel while also providing a faster spool return.

The hydraulic valve actuator 302, like the fuel injector 300, is also coupled to the engine cylinder head 322 and includes two solenoid or electromagnetic operated spool valves, generally indicated by the numerals 324 and 326. These valves preferably are single actuator, spring return valves, though could be similar to or the same as the dual return spring spool valves 304, 306 and 308 on the injector, or may be of any other suitable configuration. Valves 324 and 326 are also two-position three-way valves. Valve 324 either couples rail pressure or vents the chamber above boost piston 328, and valve 326 either supplies rail pressure or vents the region over the drive piston 330. Rail pressure is also coupled to chamber 332 below hydraulic return pins 334, though alternatively or in addition, an engine valve return spring could be used for each engine valve. In any event, the boost piston 328 has a limited travel, though the drive piston 330 has a possible travel at least as great as the maximum valve opening or lift desired.

One purpose of using a boost piston with a limited travel is to provide an increased initial engine valve opening force to open the engine valve against positive pressures that may exist in the engine combustion chamber at the time of engine valve opening. Drive piston 330 provides a force greater than the hydraulic return pins 334 (three are preferred, but lesser or more may be used) so as to be capable of forcing the engine valve to the maximum desired lift in the relatively short time desired. The control of the pressure over the boost piston can also act to slow the engine valve during engine valve closing to control the landing velocity of the engine valve.

One aspect of the present invention is that one can provide seven stable intake and seven stable exhaust flow areas (eight including zero) by appropriate proportioning and control of the hydraulic engine valve actuators. By way of example, suppose one wanted to be able to selectively control the engine valve opening (intake or exhaust valves) to provide not only full engine valve opening (as well as engine valve closed), but in addition, engine valve flow areas of 12.5%, 25%, 37.5%, 50%, 62.5% and 75% of the maximum engine valve flow area. This may be achieved as follows. The travel of the boost piston 328 in one of the associated engine valve hydraulic actuators 302 is set by design or by mechanical adjustment to have a maximum travel equal to 25% of the maximum opening of the engine valve. The boost piston 328 in the other associated hydraulic engine valve actuator may be set to have a travel equal to 50% of the full travel of the associated engine valve.

Now when an engine valve flow area of 12.5% of the flow area of both engine valves at maximum lift is desired, the control valve 324 for the boost piston 328 which has a travel equal to 25% of the maximum engine valve opening is actuated. That engine valve opens 25% of its maximum opening, at which point the boost piston reaches its mechanical stop. This provides an engine valve flow area of 12.5% of the maximum engine valve area for two valves fully open. For a flow area of 25% of the maximum engine valve flow area, the valve 324 in the other engine valve hydraulic actuator is actuated, causing that associated boost piston to open the other engine valve to 50% of its maximum opening. In a similar manner, 37.5% of the maximum flow area can be obtained by driving both boost pistons to open one engine valve halfway and the other engine valve only 25% of its maximum. A 50% flow area can be obtained by simply opening one engine valve all the way by actuating both valve 324 and valve 326 in either one of the two associated engine valve hydraulic actuators.

An engine valve flow area of 62.5% may be obtained by opening the first engine valve 25% and the second engine valve 100%, with a 75% flow area being obtained by opening the first engine valve 100% and the second engine to 50% of its maximum lift. Of course, the 100% flow area is achieved by opening both engine valves to their maximum lift.

Note that each of the foregoing states or percentage engine valve flow areas are stable states in the sense that by control of the appropriate control valves, the engine valves will go to the appropriate position for the commanded engine valve flow area without depending on the length of time the associated control valves are actuated.

In a combustion cell such as that shown in FIG. 13, the intensifier pistons 312 and 314 in the fuel injector may be powered by fuel at a suitable rail pressure, by engine oil at a suitable rail pressure, or conceivably, some other fluid. Similarly, the boost piston 328 and the drive piston 330 in each engine valve hydraulic actuator may be powered by fuel under an appropriate rail pressure, engine oil under the appropriate rail pressure, or conceivably, some other hydraulic fluid, which pressures may be the same as or different from the pressures used to power the fuel injector. Preferably, the same fluid is used for both the fuel injector and the engine valve hydraulic actuators, as this allows internal fluid coupling for simplification. The spool 318 of the spool valve in the lower part of the injector may similarly be powered by the same or by a different fluid under pressure, preferably fuel.

In the disclosure herein, the word "actuation" and perhaps variations thereof have been used with reference to various control valves, normally electrically operated spool valves. It is to be noted that actuation is used in the general sense to indicate the change of the valve from one state to another state, whether by the application of electrical power, the removal or termination of electrical power or by some other or more complicated electrical sequence.

The above description discloses certain specific embodiments the present invention. It is to be understood by those skilled in the art that further variations and enhancements may be incorporated, depending on the application, without departing from the spirit and scope of the invention, including, but not limited to, the realization of the circuit in integrated circuit (IC) form. Thus while certain preferred embodiments of the present invention have been disclosed and described herein, it will be understood by those skilled in the art that various changes in form and detail may be made therein without departing from the spirit and scope of the invention. Similarly, the various aspects of the present invention may be advantageously practiced by incorporating all features or various sub-combinations of features as desired.

INDUSTRIAL APPLICABILITY

The subject combustion cell is capable of providing comprising i) an integrated hydraulic engine valve actuation portion capable of providing two stable engine valve lift positions and ii) an integrated fuel injection portion capable of providing a selection of one, two or three injection pressure levels for injection fuel.

Other aspects, objects, and advantages of this invention can be obtained from a study of the drawings, the disclosure, and the appended claims.

We claim:

1. A combustion cell adapted for an internal combustion engine, comprising:

a hydraulic engine valve actuation portion capable of providing two different and stable engine valve lift positions; and a fuel injection portion capable of providing a selection of multiple intensifications of injection fuel;

the fuel injection portion has an injection needle that is selectively isolated from intensified injection fuel so as to minimize the fuel sealing requirements of the injection needle.

2. The combustion cell of claim 1 wherein the fuel injection portion has an injection needle that is selectively isolated from intensified injection fuel by a first valve controllably coupling the injection needle to a vent or to intensified injection fuel.

3. The combustion cell of claim 2 wherein the first valve is a hydraulically actuated valve controlled by a second valve, the second valve being an electrically operated valve.

4. The combustion cell of claim 3 wherein the first valve has a spring return operative between a valve member in the first valve and the injection needle.

5. The combustion cell of claim 3 wherein the first and second valves are spool valves.

6. The combustion cell of claim 3 wherein the first valve is physically located between an intensifier and the injection needle.

7. The combustion cell of claim 3 wherein the fuel injection portion is capable of providing at least three different intensifications of injection fuel.

8. The combustion cell of claim 7 wherein the hydraulic engine valve actuation portion includes two intake valves and two exhaust valves, the hydraulic engine valve actuation portion being capable of individually controlling each intake valve and each exhaust valve.

9. The combustion cell of claim 8 wherein the hydraulic engine valve actuation portion is configured to be able to open each intake valve to either of two intake valve lifts and to open each exhaust valve to either of two exhaust valve lifts.

10. The combustion cell of claim 9 wherein at least one of the intake valve lifts for one intake valve is not equal to either of the intake valve lifts for the other intake valve.

11. The combustion cell of claim 9 wherein at least one of the exhaust valve lifts for one exhaust valve is not equal to either of the exhaust valve lifts for the other exhaust valve.

12. The combustion cell of claim 1 wherein the fuel injection portion is capable of providing at least three different intensifications of injection fuel.

13. A combustion cell adapted for an internal combustion engine, comprising:

a hydraulic engine valve actuation portion capable of providing at least two different and stable engine valve lift positions; and a fuel injection portion capable of providing a selection of multiple intensifications of injection fuel;

the fuel injection portion has an injection needle that is selectively isolated from intensified injection fuel so as to minimize the fuel sealing requirements of the injection needle.

14. The combustion cell of claim 13 wherein the hydraulic engine valve actuation portion includes two intake valves and two exhaust valves, the hydraulic engine valve actuation portion being capable of individually controlling each intake valve and each exhaust valve.

15. The combustion cell of claim 13 wherein the hydraulic engine valve actuation portion is configured to be able to open each intake valve to either of two intake valve lifts and to open each exhaust valve to either of two exhaust valve lifts.

16. The combustion cell of claim 13 wherein at least one of the intake valve lifts for one intake valve is not equal to either of the intake valve lifts for the other intake valve.

17. The combustion cell of claim 13 wherein at least one of the exhaust valve lifts for one exhaust valve is not equal to either of the exhaust valve lifts for the other exhaust valve.

* * * * *